US007568576B2

(12) United States Patent
Sweeney, Jr. et al.

(10) Patent No.: US 7,568,576 B2
(45) Date of Patent: Aug. 4, 2009

(54) INFUSION CAP

(75) Inventors: Theodore J. Sweeney, Jr., Grosse Pointe Farms, MI (US); Drew J. Smith, Bloomfield Hills, MI (US)

(73) Assignee: Theodore Sweeney & Company, Inc., Clinton Township, MI (US)

( * ) Notice: Subject to any disclaimer, the term of this patent is extended or adjusted under 35 U.S.C. 154(b) by 276 days.

(21) Appl. No.: 11/510,438

(22) Filed: Aug. 25, 2006

(65) Prior Publication Data

US 2008/0073307 A1 Mar. 27, 2008

(51) Int. Cl.
*B65D 81/32* (2006.01)
*B65D 51/28* (2006.01)

(52) U.S. Cl. ..... 206/219; 206/221; 215/DIG. 8

(58) Field of Classification Search ..... 206/219–222; 215/DIG. 8, 228, 227; 220/521, 522; 222/145.5, 222/83

See application file for complete search history.

(56) References Cited

U.S. PATENT DOCUMENTS

| | | | | |
|---|---|---|---|---|
| 2,859,898 | A | 11/1958 | Mendenhall | |
| 3,079,022 | A | 2/1963 | Tompkins | |
| 4,203,517 | A * | 5/1980 | Hildebrandt et al. | 206/221 |
| 4,315,570 | A * | 2/1982 | Silver et al. | 206/221 |
| 4,793,475 | A | 12/1988 | Itzel | |
| 5,388,690 | A * | 2/1995 | Mutterle et al. | 206/222 |
| 5,465,835 | A | 11/1995 | Schumacher et al. | |
| 5,542,528 | A * | 8/1996 | Lanfranconi et al. | 206/221 |
| 5,794,802 | A * | 8/1998 | Caola | 215/11.1 |
| 5,927,549 | A * | 7/1999 | Wood | 222/83 |
| 5,967,309 | A | 10/1999 | Robles-Gonzalez et al. | |
| 6,257,428 | B1 * | 7/2001 | Caola | 215/11.1 |
| 6,372,270 | B1 | 4/2002 | Denny | |
| 6,820,740 | B1 | 11/2004 | Spector | |
| 6,840,373 | B2 | 1/2005 | Gibler et al. | |
| 6,854,595 | B2 * | 2/2005 | Kiser | 206/222 |
| 2005/0218015 | A1 | 10/2005 | Spector | |
| 2006/0118435 | A1 * | 6/2006 | Cronin et al. | 206/219 |

OTHER PUBLICATIONS

U.S. Appl. No. 11/436,827.

* cited by examiner

*Primary Examiner*—Mickey Yu
*Assistant Examiner*—Steven A. Reynolds
(74) *Attorney, Agent, or Firm*—Brooks Kushman P.C.

(57) ABSTRACT

An infusion cap for a bottle having a threaded neck is screwed onto the threaded neck of a bottle; and, by removing a locking tab, a portion of the cap can be pressed toward the bottle to discharge an infusion substance into the bottle.

10 Claims, 2 Drawing Sheets

INFUSION CAP

BACKGROUND OF THE INVENTION

1. Field of the Invention

This invention relates to a bottle closure cap for containing an infusion substance in a reservoir in the cap, and when desired the infusion substance can be deposited in the bottle to mix with material contained in the bottle without removing the cap from the bottle.

2. Background Art

The prior art shows several approaches to providing an infusion cap with infusion material stored in the cap for dispensing into a bottle or container for mixing with a liquid or other substance in the bottle. Typical of the prior art are the following U.S. Pat. Nos. 2,859,898, 3,079,022, 4,793,475, 5,465,835, 5,967,309, 6,372,270, 6,820,740, 6,840,373 B2, U.S. patent application Ser. No. 11/436,827, and U.S. Patent Application Publication No's. 2005/0218015 A1.

SUMMARY OF THE INVENTION

The invention provides an infusion cap for use on bottles having a cylindrical neck. The infusion cap includes a barrel having concentric inner and outer cylinder portions having upper and lower ends to be received, lower-end-first, over the bottle neck. The barrel has an upwardly opening third cylinder portion extending upwardly at the upper ends of and concentric with the inner and outer cylinder portions. The infusion cap also has a plunger closing the lower end of the inner cylinder portion and a reservoir cap enclosing the upper end of the third cylinder portion. The reservoir cap, plunger and barrel form a closed infusion substance reservoir with the plunger responsive to depression of the reservoir cap to pressurize the infusion substance reservoir into a bottle neck and allow discharge of an infusion substance from the infusion substance reservoir into a bottle. The plunger has a stem extending to the reservoir cap whereby depression of the reservoir cap shifts the plunger to pressurize and then open the infusion substance reservoir.

A removable locking tab is also disposed between the reservoir cap and the outer cylinder portion to prevent unintended depression of the reservoir cap. The reservoir cap is slidably and sealingly mounted on the third cylinder portion. The closed infusion substance reservoir is threadably mounted on the bottle neck and is bodily removable therefrom or replaceable thereon without discharging the infusion substance from the infusion substance reservoir. The reservoir cap is generally cup shaped and is received over the upper end of the third cylinder portion to effect an infusion-tight seal therewith and is shiftable toward the upper ends of the inner and outer cylinder portions to allow depression of the plunger and resulting pressurization of the infusion substance and its discharge from the infusion substance reservoir into the bottle upon which the infusion cap is mounted.

DETAILED DESCRIPTION OF THE PREFERRED EMBODIMENT(S)

Figure 1:
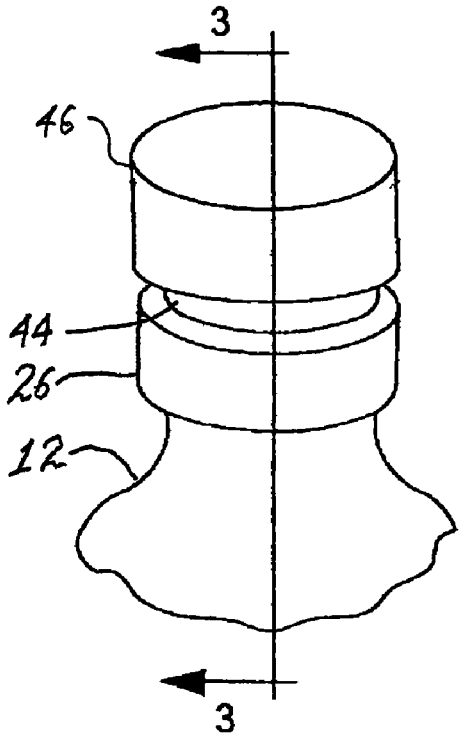
FIG. 1 shows the infusion cap of the present invention mounted on a bottle.
Figure 2:
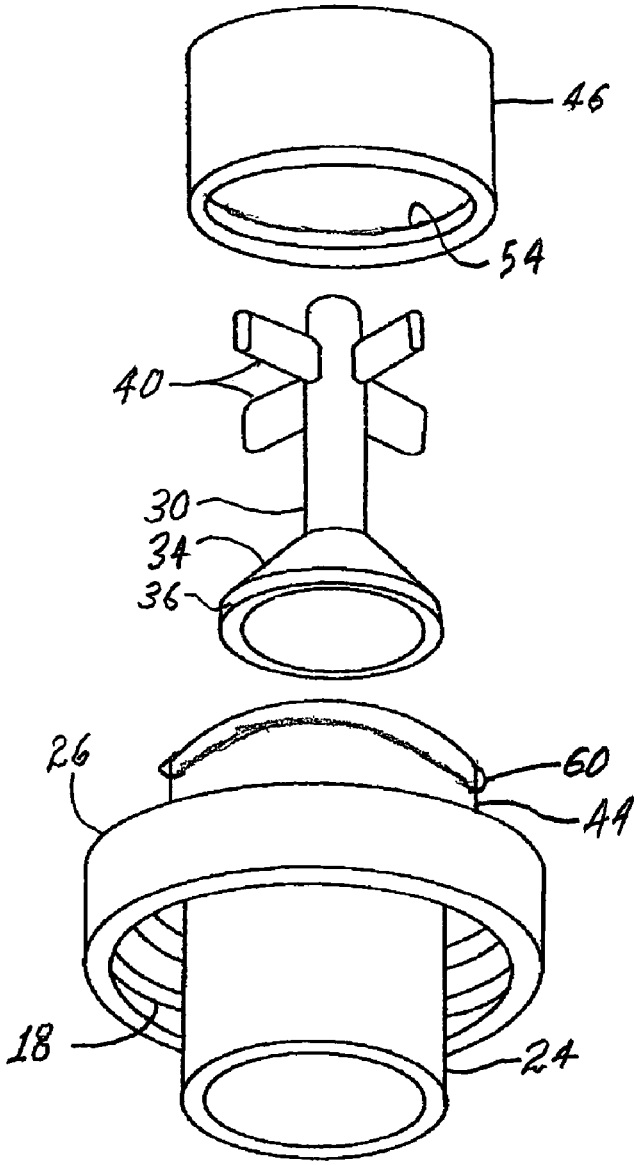
FIG. 2 is an exploded view of the components making up the infusion cap of FIG. 1.

FIGS. 1 and 2 show a preferred embodiment of an infusion cap 10 of the present invention mounted upon a neck 14 of a conventional bottle 12. It is to be noted that, although the container 12 is referred to as a bottle, it may be of any desired configuration and may not be a "bottle" as that term is commonly used. The "bottle" 12 may be formed of plastic, glass, metal, or any other material appropriate for the circumstances. At the time the bottle 12 is filled, the infusion cap 10 may be locked on the neck 14 in any suitable fashion, such as by threaded engagement of external threads 16 on the bottle neck 14 and of internal threads 18 within the infusion cap 10. Alternatively, the infusion cap 10 could be staked or otherwise permanently and nonrotatably secured in place on the bottle 12.

Figure 3:
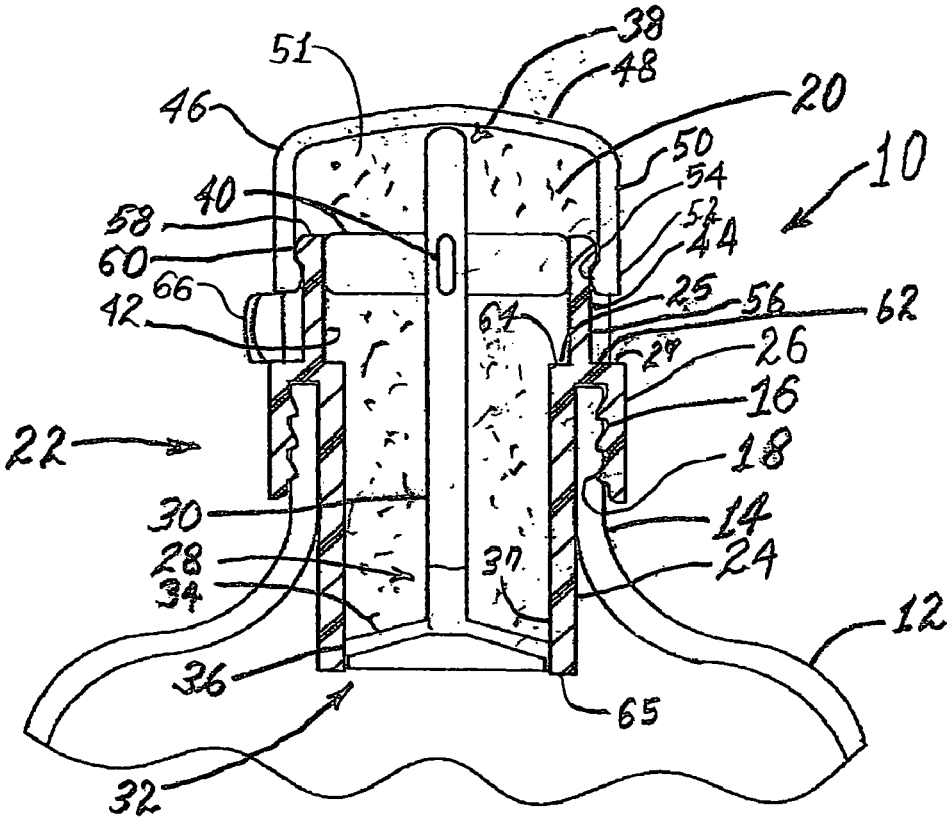
FIG. 3 is a cross-sectional view taken on the line 3-3 of FIG. 1.
Figure 4:
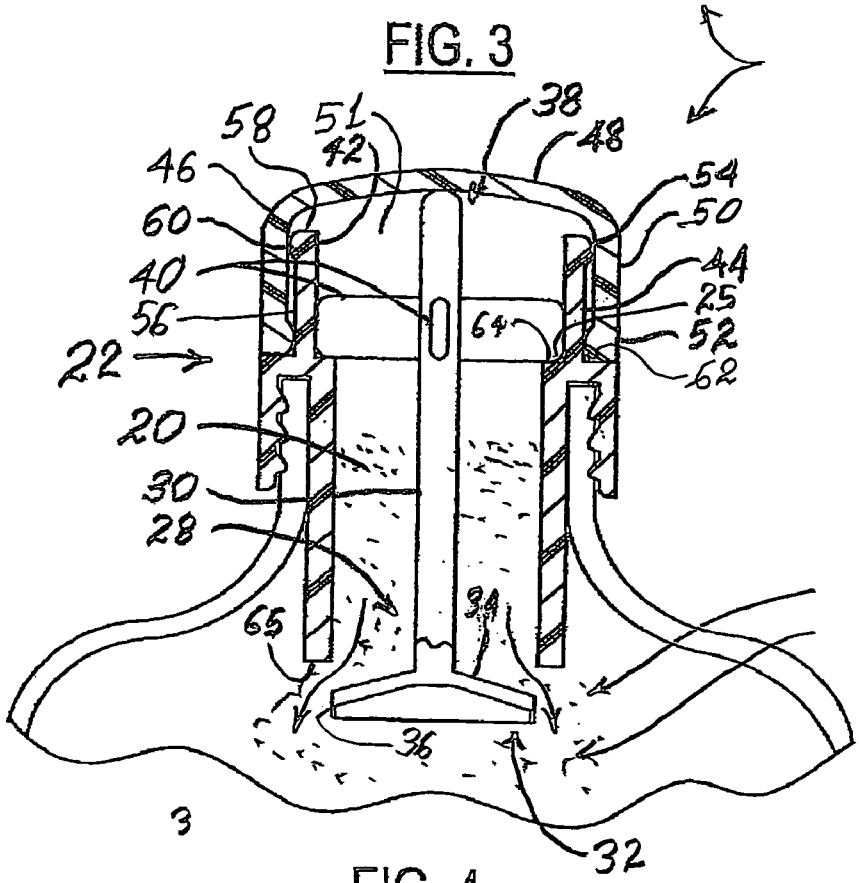
FIG. 4 shows the structure of FIG. 3 with the components positioned to discharge an infusion substance into the bottle.

As shown by FIGS. 3 and 4, the infusion cap 10 may be placed on the bottle 12 with an infusion substance 20 in the infusion cap 10 at the time the bottle is filled with a substance with which the infusion substance 20 is to be mixed. Alternatively, the bottle 12 may be provided with a conventional cap; and a user may remove such cap and place the infusion cap 10 upon the bottle 12 and store it for future use. It is contemplated that bottles 12 may be of conventional design and configuration such as conventional water-filled plastic bottles, beverage bottles and the like. Medicines may be dispensed with this system and even alcoholic beverages may be provided in which the alcohol is in the infusion cap 10 and soda water or drinking water, or the like, in the bottle 12. The infusion cap 10 may find use wherever it is desirable to separate substances in the bottle from that in the infusion cap 10 until the mixture is to be used. The infusion cap 10 may contain liquid or powder substances, as may the bottle 12 itself.

The infusion cap 10 includes a barrel, generally indicated by the reference numeral 22, having concentric inner and outer cylinder portions 24 and 26, respectively. The outer cylinder portion 26 is provided with the internal threads 18 matching the external threads 16 on the bottle 12, whereby the barrel may be threaded onto the threaded neck 14 of the bottle 12. The inner and outer cylinder portions 24 and 26 have upper ends 25 and 27, respectively, that join at the upper end of the threaded neck 14 of the bottle 12 and a sealing ring, such as an o-ring (not shown), may be utilized to seal the infusion cap 46 onto the bottle 12. The inner cylinder portion 24 telescopes downward into the neck 14 of the of the bottle 12. A third cylinder portion 44 extends concentrically upwardly from a junction of the inner and outer cylinder portions 24 and 26, respectively, and is generally aligned with a vertically elongate space defined between the inner and outer cylinder portions 24 and 26.

A plunger, generally indicated by the reference numeral 28, extends coaxially within the barrel 22. The plunger 28 has a vertical stem 30 extending upwardly to a reservoir cap 46 and terminating at a lower end, generally indicated by the numeral 32, of the plunger 28 in a conically shaped head 34 atop a short cylindrical section 36. The stem 30 has an upper end, generally indicated by the reference numeral 38, proximate which at least three spokes 40 extend from attachments to the stem 30 to points where the spokes 40 are in slidable contact with the inner surface 42 of the third cylinder portion 44. The spokes 40 support the plunger 28 and maintain an axial alignment of the upper end 38 of the stem 30 within the barrel 22. Due to its conservative configuration, the plunger 28 is easily fabricated by, but is not limited to being fabricated by, a molding process.

The reservoir cap 46, which has a general configuration of an inverted cup, has a top portion 48, sides 50 and a rim 52. The rim 52 has an inwardly extending lip 54, which slidably and sealingly contacts an outer surface 56 of the third cylinder portion 44 to prevent the infusion substance 20 from leaking between the third cylinder portion 44 and the reservoir cap 46. An upper end 58 of the third cylinder portion 44 has an outwardly extending lip 60, which cooperates with the inwardly extending lip 54 of the reservoir cap 46 to limit the upward movement of the reservoir cap 46, as best illustrated by FIG. 3. It is to be noted that means, such as a resilient O-ring (not shown) or the like, other than the lips 54 and 60, could be used to prevent leakage of the infusion substance 20 from the infusion substance reservoir 51. The upper end 27 of the outer cylinder portion 26 forms a shoulder 62 that limits the downward movement of the reservoir cap 46, as best illustrated by FIG. 4. The upper end 25 of the inner cylinder portion 24 forms a plunger-retaining seat 64 that limits the downward movement of the plunger spokes 40, thus retaining the plunger 28 within the infusion cap 10 after the shifted plunger 28 has opened the lower end of the inner cylinder portion 24 and also after the infusion cap 10 has been removed from the bottle 12 upon which it has been mounted. The short cylindrical section 36 of the plunger 28 slidably and sealingly contacts an inner surface 37 of the inner cylinder portion 24 at a lower end 65. The space defined between the reservoir cap 46, the third cylinder portion 44, the inner cylinder portion 24, and the lower end 32 of the plunger 28 forms a closed infusion substance reservoir 51. The engagement between the short cylindrical section 36 of the plunger 28 and the inner surface 37 of the inner cylinder portion 24 is a press fit so that infusion material 20 in the infusion substance reservoir 51 will not seep into the bottle 12. Furthermore, the seal effected by the press fit between the surfaces 36 and 37 results in a pressurization of the infusion substance 20 as the reservoir cap 46 is depressed just before the infusion reservoir is opened, which results in a burst-like expulsion of the infusion substance into the bottle neck.

Since the short cylindrical section 36 that seals the infusion substance reservoir 51 has the same diameter as does the inside of the inner cylinder portion 24, maximum clearance is provided for a greater flow of infusion substance 20 when the infusion substance reservoir 51 is opened. Being press-fitted into the lower end 65 of the inner cylinder portion 24 of the barrel 22, the short cylindrical section 36 that seals the infusion substance reservoir 51 requires no inwardly projecting seat, which could slow, catch and retain downwardly flowing infusion substances 20. Moreover, the conical shape of the head 34 atop the short cylindrical section 36 provides a minimal likelihood of slowing, catching and retaining downwardly flowing infusion substances 20. The lack of obstructive features within the infusion substance reservoir 51 and in the infusion substance exit path are particularly beneficial when infusing powders. It is to be noted that flow-enhancing substances can be added to the infusion substance 20.

A removable locking tab 66 (FIG. 3) is disposed between the upper end 27 of the outer cylinder portion 26 and the rim 52 of the reservoir cap 46 to prevent an unintended downward displacement of the reservoir cap 46. The tab 66 may be made of a resilient material that allows the tab 66 to be snapped into position. Upon removal of the tab 66, the reservoir cap 46 may be depressed. A downward movement of the reservoir cap 46 forces the plunger stem 30 downward, as best illustrated by FIG. 4. The short cylindrical section 36 of the plunger 28 is forced from within the inner cylinder portion 24, and the infusion substance 20 is allowed to discharge into the bottle 12.

While embodiments of the invention have been illustrated and described, it is not intended that these embodiments illustrate and describe all possible forms of the invention. Rather, the words used in the specification are words of description rather than limitation; and it is understood that various changes may be made without departing from the spirit and scope of the invention.

What is claimed is:

1. An infusion cap for use on bottles having a cylindrical neck, the infusion cap comprising:

a single molded structure consisting of a barrel having concentric inner and outer cylinder portions having upper and lower ends to be received lower-end-first over the bottle neck;

an upwardly opening third cylinder portion integral with said barrel and having upper and lower ends and extending upwardly from the barrel at the upper ends of and concentric with said inner and outer cylinder portions;

a plunger closing the lower end of said inner cylinder portion;

a reservoir cap enclosing the upper end of the third cylinder portion, the reservoir cap, plunger and barrel forming a closed infusion substance reservoir with the plunger axially shiftable in the reservoir and responsive to depression of the reservoir cap to pressurize the infusion substance within the reservoir and force it out of said reservoir and into a bottle neck upon which the infusion cap is mounted.

2. The invention defined by claim 1, wherein the plunger has a stem extending to the reservoir cap whereby depression of the reservoir cap shifts the plunger to pressurize and then open the infusion substance reservoir.

3. The invention defined by claim 1, wherein the reservoir cap is slidably and sealingly mounted on the third cylinder portion.

4. The invention defined by claim 3, wherein the infusion substance reservoir can be bodily removed from a bottle neck on which the infusion cap is mounted without discharging the infusion substance in the infusion substance reservoir.

5. The invention defined by claim 1, wherein the infusion cap is threadably mounted on the bottle neck and removable therefrom or replaceable thereon without discharging the infusion substance from the infusion substance reservoir.

6. The invention defined by claim 1, wherein the reservoir cap is generally cup shaped and is received over the upper end of the third cylinder portion to effect an infusion-tight seal therewith and is shiftable toward the upper ends of the inner and outer cylinder portions first to depress the plunger and then allow discharge of the infusion substance from the infusion substance reservoir into a bottle upon which the infusion cap is mounted.

7. The invention defined by claim 1, wherein a removable locking tab is disposed between the reservoir cap and the outer sleeve portion to prevent unintended depression of the reservoir cap.

8. An infusion cap for use on bottles having a cylindrical neck, the infusion cap comprising:

a single molded structure consisting of a barrel having concentric inner and outer cylinder portions with the outer cylinder portion being internally threaded for threaded engagement, lower-end-first, over an externally threaded bottle neck and with the inner cylinder portion received downwardly within the bottle neck;

an upwardly opening third cylinder portion integral with said barrel and extending upwardly from the barrel at the upper ends of and concentric with said inner and outer cylinder portions;

a plunger closing the lower end of said inner cylinder portion and having a stem extending upwardly through the inner and third cylinder portions and supported thereby for axial displacement; and a reservoir cap closing the upper end of the third cylinder portion and disposed to engage the stem and be axially shiftable on the third cylinder portion, the reservoir cap, plunger and barrel forming a closed infusion substance reservoir with the plunger axially shiftable in the reservoir and responsive to axial displacement of the reservoir cap to pressurize the infusion substance within the reservoir and force it out of said reservoir and into a bottle neck upon which the infusion cap is mounted.

9. The invention as defined by claim 8, wherein the plunger stem has radiating spokes for engaging one of the cylinder portions for supporting the plunger in the infusion substance reservoir.

10. The invention defined by claim 9, wherein one of the cylinder portions has a plunger-retaining seat for engaging the plunger spokes and for cooperating with the reservoir cap when it has shifted the plunger, retaining the plunger within the infusion cap after the shifted plunger has opened the lower end of the inner cylinder portion and also after the infusion cap has been removed from the bottle upon which it has been mounted.

* * * * *